US008240183B2

(12) United States Patent
Berge

(10) Patent No.: US 8,240,183 B2
(45) Date of Patent: Aug. 14, 2012

(54) METHOD FOR THE TEMPERATURE TREATMENT OF EXTRUSION TOOLS

(75) Inventor: George Berge, Borås (SE)

(73) Assignee: IUT Industriell Ugnsteknik Sweden, Harryda (SE)

( * ) Notice: Subject to any disclaimer, the term of this patent is extended or adjusted under 35 U.S.C. 154(b) by 1007 days.

(21) Appl. No.: 12/090,862

(22) PCT Filed: Nov. 17, 2006

(86) PCT No.: PCT/SE2006/001305
§ 371 (c)(1),
(2), (4) Date: May 19, 2008

(87) PCT Pub. No.: WO2007/058597
PCT Pub. Date: May 24, 2007

(65) Prior Publication Data

US 2010/0175453 A1 Jul. 15, 2010

(30) Foreign Application Priority Data

Nov. 21, 2005 (SE) ..... 0502546

(51) Int. Cl.
*B21D 37/16* (2006.01)

(52) U.S. Cl. ..... 72/342.7; 72/342.2; 72/342.4; 72/253.1

(58) Field of Classification Search ..... 29/447; 148/640, 641, 627, 634; 266/252, 259; 72/342.2–342.4, 259, 272, 253.1, 342.8
See application file for complete search history.

(56) References Cited

U.S. PATENT DOCUMENTS 3,615,927 A * 10/1971 Paulson ..... 148/640
3,874,207 A * 4/1975 Lemelson ..... 72/56
4,829,802 A 5/1989 Baumann
5,157,955 A * 10/1992 Hawkes et al. ..... 72/262
5,600,990 A * 2/1997 Kelly et al. ..... 72/255

FOREIGN PATENT DOCUMENTS

GB 815958 A 7/1959
KR 1020030061204 * 3/2005

OTHER PUBLICATIONS

Swedish Patent Office, Intl Search Report in PCT/SE2006/001305, Feb. 22, 2007.
Intl Bureau of WIPO, Intl Preliminary Report on Patentability in PCT/SE2006/001305, Jun. 5, 2008.

* cited by examiner

*Primary Examiner* — Edward Tolan
*Assistant Examiner* — Pradeep C Battula
(74) *Attorney, Agent, or Firm* — Potomac Patent Group PLLC

(57) ABSTRACT

Method upon heating of extrusion tools (1) for the extrusion of metal into a profile and which extrusion tool is formed by an internal tool (5) that is receivable by a tool ring (4) and that has the intended hole-profile openings (6). In that connection, the entire extrusion tool (1) is heated, after which the temperature of the tool ring (4) only is lowered before subsequent introduction of the extrusion tool (1) into the press and the execution of the extrusion.

6 Claims, 2 Drawing Sheets

METHOD FOR THE TEMPERATURE TREATMENT OF EXTRUSION TOOLS

Figure 1:
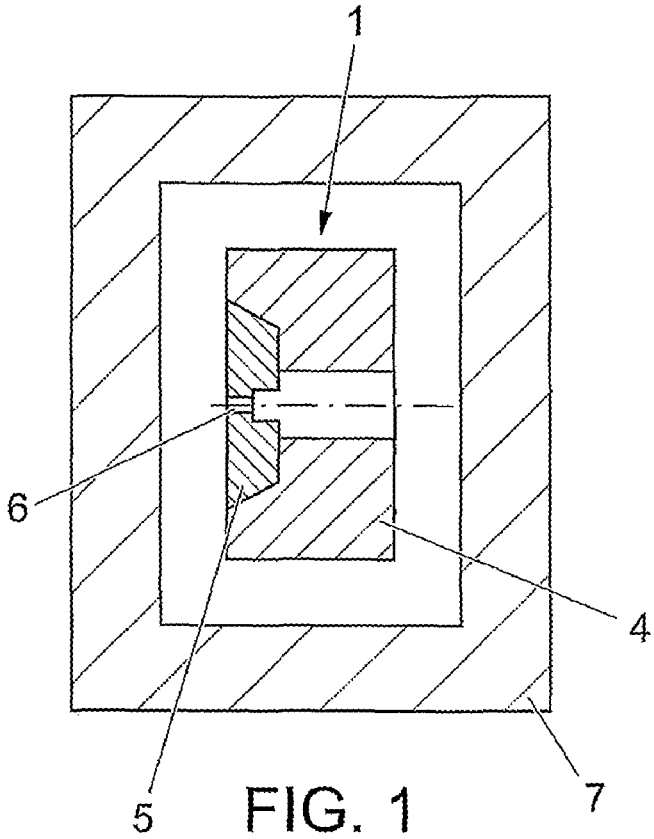

This application is a 371 of International Application No. PCT/SE2006/001305 filed on 17 Nov. 2006 and claims the benefit of the filing date of that International Application. This application also claims priority from Application No. 0502546-5 filed in Sweden on Nov. 21, 2005.

The present invention relates to a method upon heating of extrusion tools for the extrusion of metal into a profile and which extrusion tool is formed by an internal tool that is receivable by a tool ring and that has the intended number of hole-profile openings.

Within aluminium-profile plants, tools are used through which aluminium ingots of high temperature and high pressure are extruded into aluminium profiles having the circumferential shape and structure that the internal hole shape of the tool presents, occasionally also supplemented with a central mandrel for the formation of hole-shaped profiles, such as, e.g., tubes. In order to achieve optimum function, the tools are preheated before they are put into the press with the purpose of avoiding those changes of the quality of the manufactured profiles that otherwise would arise while the tools are heated from room temperature to the so-called steady-state temperature, which they reach because of the generated friction heat from the preheated ingots when the same are extruded through the tools.

An extrusion tool is normally composed of two or more parts, which, before the preheating of the tool, are assembled into a common unit, viz. a tool that is internally receivable in an outer ring-shaped holder and that has the intended number of hole-profile openings. By allowing said parts to be put together before the preheating, the entire composed unit gets the same temperature upon the preheating, i.e., that the internal tool and the tool holder become equally hot. In steady-state operation of the press, the proper tool has a temperature of between +500° C. and +600° C. while the surrounding tool holder ring has a temperature that is substantially lower, between +300° C. and +400° C. During the time that said combined tool/ring unit is adapted to the steady-state temperature, using known technique, negative quality changes of the profile material arise in the same way as has been described above, and which result in a high scrap portion with accompanying high costs because of substantial rejections.

By means of today's known technique, the composed tool unit is heated up to approx. +450° C., since at a higher starting temperature, the ring does not manage to conduct the heat away from the proper tool sufficiently fast in order not to subject the same, on that occasion, to temperatures with accompanying melting as a consequence.

By U.S. Pat. No. 4,829,802 A, it is previously known to allow cooling around the extrusion work piece in question in the extrusion press in order to be able to increase the speed of the extrusion, but this does not solve the problem discussed above.

Therefore, the main object of the present invention is primarily to solve said problem with the heating of the tool in an efficient and smart way.

Said object is attained by means of a method according to the above-mentioned type and that substantially is characterized in that the entire extrusion tool is heated, after which the temperature of the tool ring only is lowered before subsequent introduction of the extrusion tool into the press and the execution of the extrusion.

Figure 2:
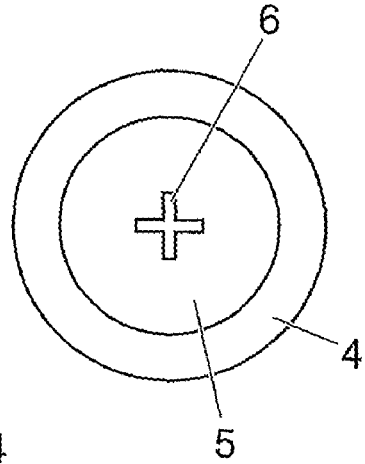
Figure 3:
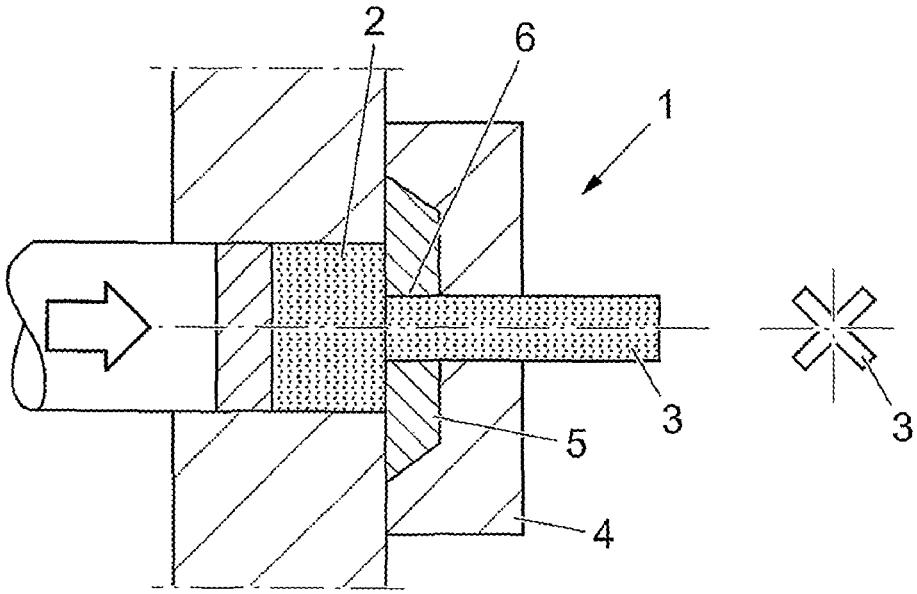
Figure 4:
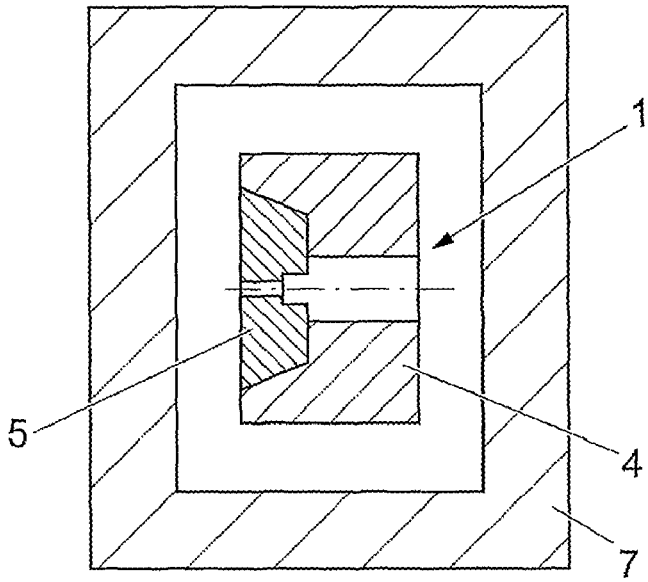
Figure 5:
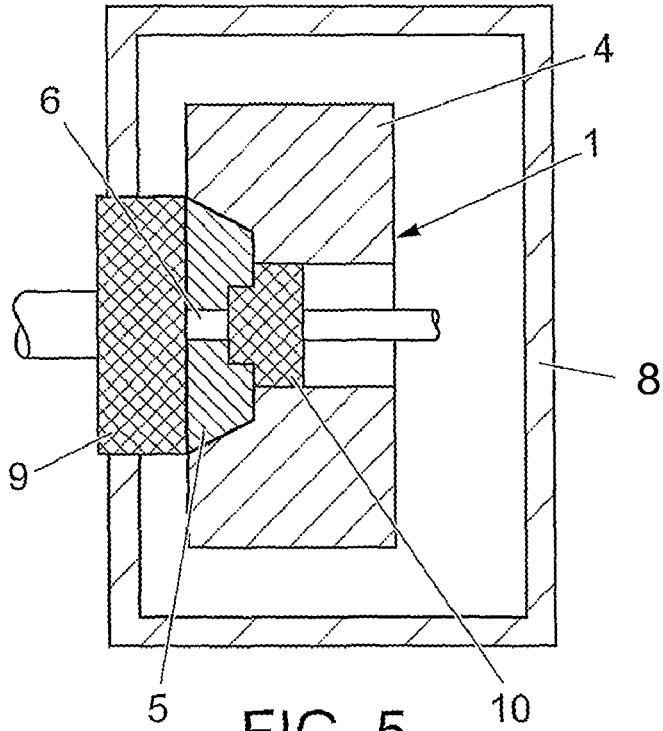

Below, the invention is described in the form of a preferred embodiment example, reference being made to the accompanying drawings, in which FIG. 1 shows a section view of an extrusion tool, FIG. 2 shows a plan view of the extrusion tool, FIG. 3 shows the extrusion tool in an active extrusion position, FIG. 4 shows the extrusion tool during heating, and FIG. 5 shows the extrusion tool during cooling of a part of the same.

The present invention relates to a method comprising heating/cooling and that allows the combined tool unit, upon introduction into the occurring extrusion press, to have the temperatures in two or in several zones that are attained upon so-called steady state, and that thereby the negative quality changes that normally arise upon adjustment of the temperature to the intended operation temperature can be avoided.

More precisely, there is intended a method upon heating of the extrusion tool 1 used for the extrusion of metal in the form of thicker extrusion work pieces 2 into a thinner desired profile 3 and which extrusion tool is formed by an internal tool 5 that is receivable and clamped in a tool ring 4 and that has the intended hole-profile opening 6. According to the invention, the entire extrusion tool 1 is heated in a furnace 7 including a protective gas, e.g., nitrogen gas ($N_2$), after which the temperature of the tool ring 4 is lowered before subsequent introduction of the extrusion tool 1 into the intended press 8 and the execution of the extrusion in a known way.

The entire extrusion tool 1 is heated to a temperature that is between +500° C. and +600° C. in a furnace atmosphere of, e.g., nitrogen gas, preferably to approx. +580° C.

Next, only the tool ring 4 is cooled to a temperature that is between +300 and +400° C., preferably to approx. +350° C.

The heating of the entire extrusion tool 1 is carried out in a furnace including a hydrogen-gas atmosphere instead of, as earlier, to between +450° C. and 480° C. Naturally, another common heat source than the furnace 7 may be used. After the common heating of the entire extrusion tool 1, only the tool ring 4 is cooled in a cold-storage chamber 8 or by means of another cooler and under simultaneous heat insulation of the internal tool 5 situated at the centre of the tool ring. The cooler may also be provided with a hydrogen-gas atmosphere in case it is necessary to minimize the oxidation because of the holding time in the cooler. In that connection, suitable heat insulation 9, 10 of materials that withstand the intended temperature may be used. It is, e.g., possible to join suitable bodies of heat insulation materials to the free surfaces of said internal tool so that the same are not subjected to cooling but are kept heat-insulated.

The time during which the entire extrusion tool 1 is affected to be allowed to be heated, e.g., a furnace 7 may vary between 1 and 7 h, while the time said tool ring 4 is cooled may vary between ½ and 1½ h.

The method in question to let heat and cool, respectively, the extrusion tool and parts thereof is especially intended to adapt the tool to the so-called steady state of aluminium, i.e., when the production parameters are stable, but the invention may also be applied to other light metals and alloys of the same.

Naturally, the invention is not limited to the embodiment described above and shown in the accompanying drawings. Modifications are feasible, particularly as for the nature of the different parts, or by using an equivalent technique, without departing from the protection area of the invention, such as it is defined in the claims.

The invention claimed is:

1. A method of heating of an extrusion tool for extrusion of metal into a profile, the extrusion tool being formed by an internal tool that is receivable by a tool ring and that has an intended number of hole-profile openings, comprising heating the entire extrusion tool to a temperature that is between +500° C. and +600° C., and after the heating, lowering the temperature of only the tool ring by cooling only the tool ring to a temperature that is between +300° C. and +400° C. before subsequently introducing the extrusion tool into a press and executing the extrusion, wherein the entire extrusion tool is heated in a common furnace and the tool ring is cooled in a cold-storage chamber under simultaneous heat insulation of the internal tool situated at the center thereof.

2. The method of claim 1, wherein the entire extrusion tool is heated to approximately +580° C.

3. The method of claim 1, wherein the tool ring is cooled to approximately +350° C.

4. The method of claim 1, wherein the entire extrusion tool is heated between 1 hour and 7 hours.

5. The method of claim 1, wherein the tool ring is cooled between ½ hour and 1½ hours.

6. The method of claim 1, wherein the heating and cooling, adapt the tool to a steady state of aluminum.

* * * * *